United States Patent [19]

Seiden et al.

[11] Patent Number: 4,580,473

[45] Date of Patent: Apr. 8, 1986

[54] HIGH SPEED INTERMITTENT MOTION PACKAGING MACHINE

[75] Inventors: Frederick C. Seiden, Bradenton; Allen B. Canfield, Whitfield; Norman W. Carey, Sarasota, all of Fla.

[73] Assignee: Rexham Corporation, New York, N.Y.

[21] Appl. No.: 592,449

[22] Filed: Mar. 22, 1984

[51] Int. Cl.[4] ..... B26D 5/20

[52] U.S. Cl. ..... 83/23; 83/98; 83/151; 271/204; 271/277

[58] Field of Search ..... 83/23, 94, 98, 99, 102, 83/107, 151, 154; 271/204–206, 85, 269, 277; 53/562

[56] References Cited

U.S. PATENT DOCUMENTS

| | | | |
|---|---|---|---|
| 2,753,798 | 7/1956 | Babst | 271/204 |
| 3,553,934 | 1/1971 | Johnson et al. | 53/183 |
| 3,762,253 | 10/1973 | Loomis, Jr. et al. | 83/102 |
| 4,320,894 | 3/1982 | Reist et al. | 271/204 |
| 4,333,559 | 6/1982 | Reist | 271/204 |

OTHER PUBLICATIONS

Brochure published by Robert Bosch GmbH, BMR200 Packaging Machine, 8 pages.

*Primary Examiner*—James M. Meister
*Assistant Examiner*—John L. Knoble
*Attorney, Agent, or Firm*—Leydig, Voit & Mayer, Ltd.

[57] ABSTRACT

An intermittent motion horizontal packaging machine in which pouches made one at a time by a pouch making section operating at a high index cycle rate are filled two at a time while being advanced in a single row by a pouch filling section operating at one-half the index cycle rate of the pouch making section.

11 Claims, 8 Drawing Figures

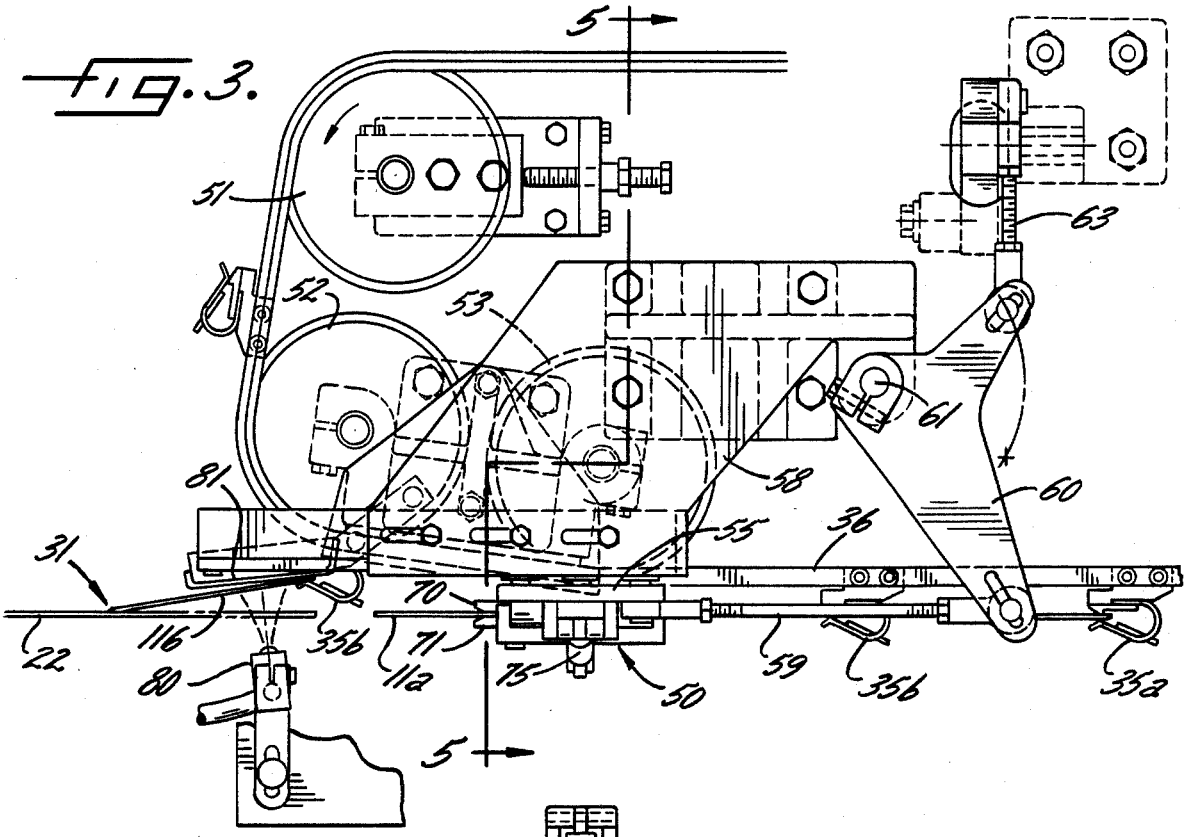
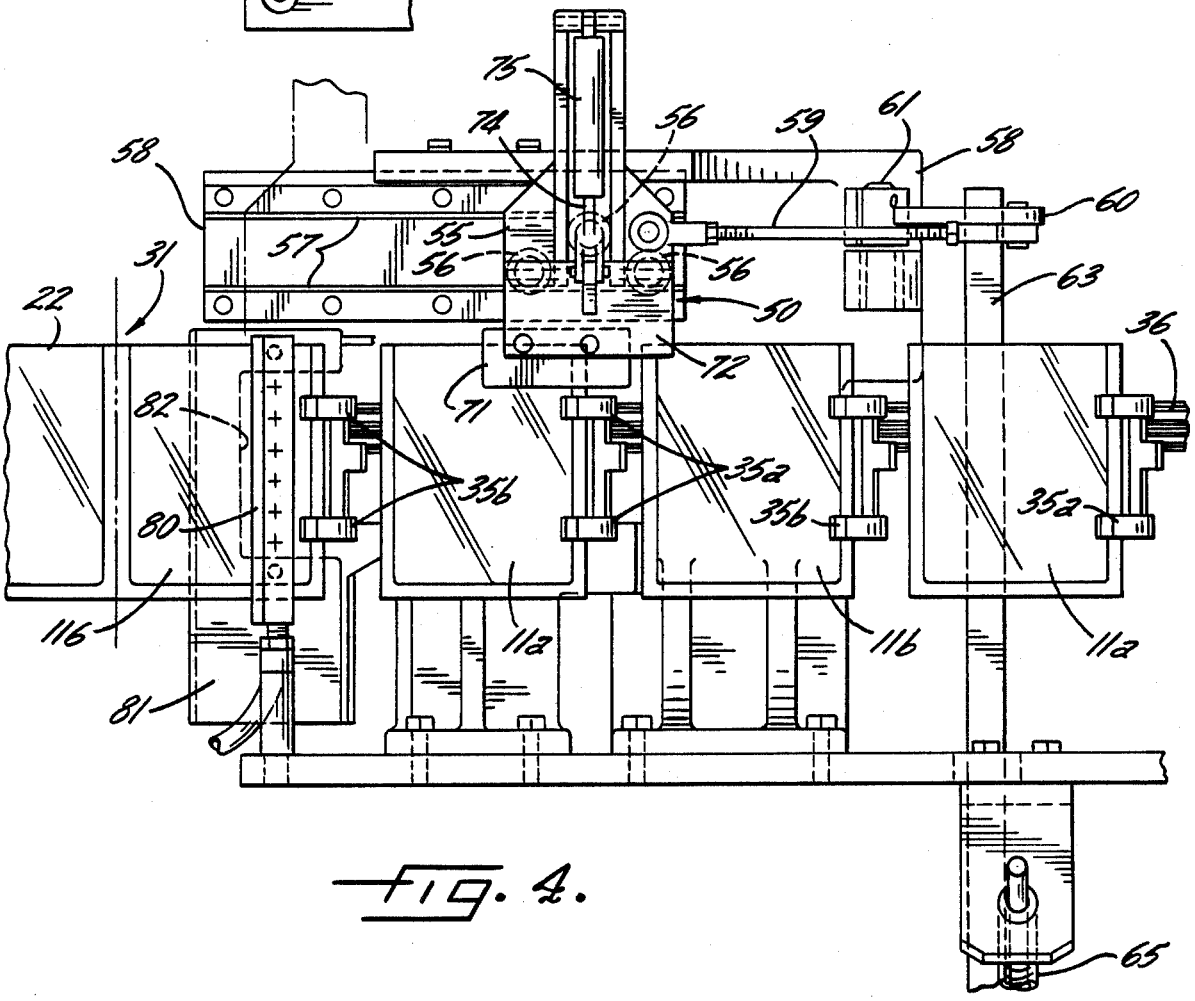
FIG. 3.
FIG. 4.

HIGH SPEED INTERMITTENT MOTION PACKAGING MACHINE

BACKGROUND OF THE INVENTION

This invention relates to a packaging machine of the type having a pouch making section for forming an elongated strip of interconnected pouches from a flexible web and further having a pouch filling section for filling and sealing the pouches after the pouches have been severed from the strip at the downstream end of the pouch making section. The machine of the invention preferably is of the intermittent motion type in which the web and the pouches are advanced intermittently or step-by-step and in which the pouch forming, filling and sealing operations take place when the web and the pouches dwell between successive steps.

It is well recognized in the packaging machine art that pouches can be made at a much faster index cycle rate than the pouches can be filled since a relatively long dwell period is required to fill the pouches. Even if multiple filling mechanisms are used to fill each pouch during successive dwell periods, the pouch filling section of a standard packaging machine must run at the same index cycle rate as the pouch making section. While the dynamic considerations involved in running the pouch making section at a high index cycle rate can be dealt with, the dynamic factors involved in running the pouch filling section at the same high cycle rate present a much more difficult problem.

In order to overcome that problem, efforts have been made to reduce the index cycle rate of the pouch filling section while still enabling that section to accommodate the entire pouch output of a high speed pouch making section. For example, Loomis, Jr. et al U.S. Pat. No. 3,762,253 discloses a dual lane packaging machine in which pouches made at a high rate by a pouch making section are divided into two laterally spaced rows for advancement through the pouch filling section. While this arrangement allows the pouch filling section to run at one-half the index cycle rate of the pouch making section, the dynamic and cost considerations of dividing the pouches into two laterally spaced rows constitute a significant drawback.

Another example of a relatively low index cycle rate but relatively high output machine is a model BMR 200 machine marketed by the Bosch Packaging Machinery Division of Robert Bosch GmbH. In that machine, pouches are made two at a time and then are indexed in such a manner as to enable the pouches to be filled and sealed two at a time. While this enables both the pouch making section and the pouch filling section to operate at an index cycle rate equal to one-half the total pouch output rate, duplicate pouch making mechanisms are required, thereby increasing the cost of the machine. In addition, the pouch web must be fed in relatively long lengths equal to the width of two pouches and thus control over the web is reduced and particularly when the pouches are cut from the strip.

SUMMARY OF THE INVENTION

The general aim of the present invention is to provide a new and improved packaging machine which is capable of forming and filling pouches at relatively high output rates without the difficulties and exceptionally high cost factors present in prior high rate machines.

A further object of the invention is to achieve the foregoing by providing a unique packaging machine in which pouches preferably made one at a time by a pouch making section operating at a high index cycle rate are filled two at a time while being advanced in a single row by a pouch filling section operating at one-half the index cycle rate of the pouch making section.

A more detailed object is to provide a packaging machine in which pouches indexed at a predetermined cycle rate by a pouch making section are uniquely transferred to pouch-holding clamps and are indexed by the clamps through the pouch filling section in a single row at one-half the index cycle rate of the pouches in the pouch making section.

The invention also resides in the provision of novel means for transferring the pouches in a single row from the pouch making section to the pouch clamps and particularly in the relatively simple means for shuttling a severed pouch to one clamp and for directly transferring the next severed pouch to another clamp.

These and other objects and advantages of the invention will become more apparent from the following detailed description when taken in conjunction with the accompanying drawings.

BRIEF DESCRIPTION OF THE DRAWINGS

FIG. 3 is an enlarged fragmentary top plan view of a certain portion of the machine as taken along the line 3—3 of FIG. 1*a*.

FIG. 4 is a front elevational view of the portion of the machine shown in FIG. 3.

DETAILED DESCRIPTION OF THE PREFERRED EMBODIMENT

Figures 1A, 1B:
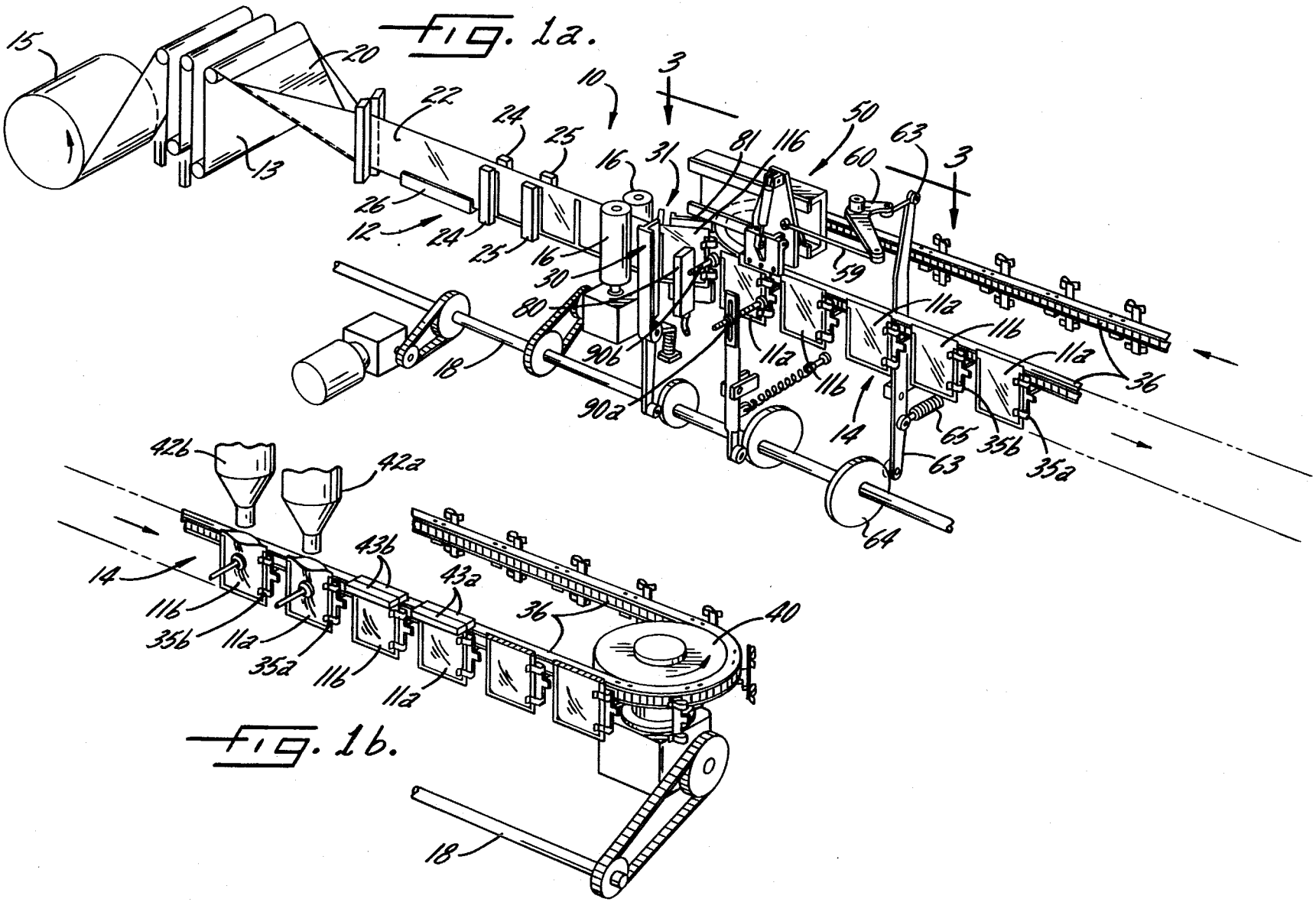
FIGS. 1*a* and 1*b* are perspective views schematically showing the upstream and downstream ends, respectively, of a new and improved packaging machine incorporating the unique features of the present invention.

As shown in the drawings for purposes of illustration, the invention is embodied in a packaging machine 10 for forming, filling and sealing substantially flat pouches 11 made of flexible material. The specific machine which has been illustrated herein is of the intermittent motion type in that the pouch material and pouches are advanced step-by-step through the various stations of the machine and dwell in the stations during the performance of packaging operations.

In many respects, the machine 10 may be of the same general type as disclosed in Johnson et al U.S. Pat. No. 3,553,934 to which reference may be made for many details of construction. Basically, the machine comprises a pouch making section 12 (FIG. 1*a*) which forms the pouches from a web 13 of flexible, heat-sealable material as the web is advanced in a horizontal direction along a predetermined path. Downstream of and disposed end-to-end with the pouch making section is a pouch filling section 14 (FIGS. 1*a* and 1*b*) to which the newly formed pouches are transferred for filling and closing during advancement along an extension of the path.

To form each pouch 11, a length of web 13 is pulled from a supply roll 15 (FIG. 1*a*) and is advanced step-by-step by a pair of intermittently rotatable feed rolls 16 driven by a continuously rotatable cycle shaft 18. The feed rolls are driven such that they advance the web through steps each equal in length to the width of each pouch. During the advance, the web is pulled beneath a plow 20 which folds the web upwardly to form an elongated strip 22 defined by two face-to-face panels whose lower margins are joined by a bottom fold. When the strip dwells between successive steps, two coacting heated bars 24 form vertically extending seals at longitudinally spaced increments along the strip, such seals defining the side seals of the pouches 11. The side seals subsequently may be chilled by a pair of coacting cooling bars 25. If desired, an additional pair of heated bars 26 may be positioned along the path to form seals along the bottom fold of the strip.

After the side seals have been formed, a cutting unit 30 (FIG. 1*a*) positioned along the path at a cutting station 31 cuts through each seal about midway between the edges thereof in order to separate each leading pouch 11 from the strip 22, there herein being one pouch cut from the strip each time the strip dwells. The cutting unit comprises a swingable blade 33 (FIG. 2*a*) driven by the cycle shaft 18 and coacting with a fixed blade 34. Each pouch is cut from the strip when the pouch dwells in the cutting station with its trailing margin located between the blades (see FIGS. 2*a* and 4).

After being severed from the strip 22, each pouch 11 is gripped by a pouch clamp 35 (FIGS. 3 and 4). Several clamps are spaced equally along a chain 36 (FIGS. 1*a* and 1*b*) which forms part of the pouch filling section 14 of the machine 10. The chain is trained around a downstream drive sprocket 40 (FIG. 1*b*) adapted to be rotated intermittently by the cycle shaft 18. When the chain is indexed, the clamps advance the pouches edgewise along a path which is in line with and which forms a straight continuation of the path of the strip 22. When the clamps dwell between successive steps, the pouches are first filled with product and then their upper ends are heat sealed.

In a machine 10 of the type described thus far, the pouch making section 12 is capable of operating at a relatively high index cycle rate to produce a relatively large number of pouches 11 in a given period of time. The pouch filling section 14, however, cannot operate at such a high index cycle rate and, in a standard packaging machine, the pouch filling section simply cannot be operated at a sufficiently high index cycle rate to handle the maximum pouch output which the pouch making section is capable of producing. Assume, for example, that the pouch making section 12 produces one pouch during each index cycle and is capable of producing as many as 200 pouches per minute. In a standard machine, the pouch filling section simply cannot be operated at an index cycle rate much higher than 150 pouches per minute and thus cannot accommodate the maximum pouch output of the pouch making section. There are two primary factors which contribute to the inability of a standard pouch filling section to be operated at the same high index cycle rate as the pouch making section. First, a certain amount of dwell time is required to fill the pouches. While the time available for filling the pouches can be increased by using multiple filling mechanisms rather than a single filling mechanism, difficulty nevertheless is still encountered in a standard machine in dealing with the dynamic problems resulting from starting and stopping the chain at an index cycle rate significantly higher than 150 pouches per minute. Some attempts have been made previously to increase the pouch output rate of the pouch filling section while maintaining a relatively low index cycle rate but, as discussed above, those attempts have resulted in relatively expensive machines which in themselves have certain technological disadvantages.

The present invention contemplates a new and improved packaging machine 10 in which the pouch filling section 14 handles the entire output of pouches 11 of the high speed pouch making section 12 while being operated at a fraction of the index cycle rate of the pouch making section and while advancing all of the pouches in a single row. As a result of this principle, the machine 10 is relatively inexpensive when compared to prior machines having substantially the same high output capacity and, in addition, better control may be maintained over the pouch strip 22.

In general, the foregoing is achieved by severing the pouches 11 from the strip 22 one at a time and by transferring a first severed pouch 11*a* (FIGS. 2*a* to 2*c*) to the leading clamp 35*a* of a set of paired clamps which periodically dwell adjacent the cut-off station 31. While the pair of clamps continues to dwell, the strip 22 is indexed, the next pouch 11*b* is severed from the strip, and such pouch is gripped by the trailing clamp 35*b* of the pair. The chain 36 then is advanced to index the paired clamps through a distance equal to twice the center-to-center distance or pitch of the pouches in such clamps and to present the next pair of clamps to the cut-off station. When the chain subsequently dwells, the pouch 11*a* in each leading clamp 35*a* of each pair is filled with product by a filler 42*a* (FIG. 1*b*) while the pouch 11*b* in each trailing clamp 35*b* is filled with product by a filler 42*b*. At downstream stations, top sealing units 43*a* and 43*b* seal the upper ends of the pouches 11*a* and 11*b* in the leading and trailing clamps 35*a* and 35*b*, respectively.

Accordingly, the severed pouches 11 are indexed once by the chain 36 each time the pouch strip 22 is indexed twice by the feed rolls 16 so that the pouch filling section 14 of the machine 10 is run at only one-half the index cycle rate of the pouch making section 12 thereby to reduce the frequency with which the chain is started and stopped and to reduce the acceleration and deceleration stresses applied to the chain. Even though running at only one-half the index cycle rate of the pouch making section, the pouch filling section still is able to accommodate the entire output of pouches of the pouch making section in a single row since the severed pouches are indexed through a distance equal to twice the pitch of adjacent severed pouches at the same time the strip 22 is being indexed through a distance equal only to the pitch of adjacent interconnected pouches in the strip.

Figure 2A:
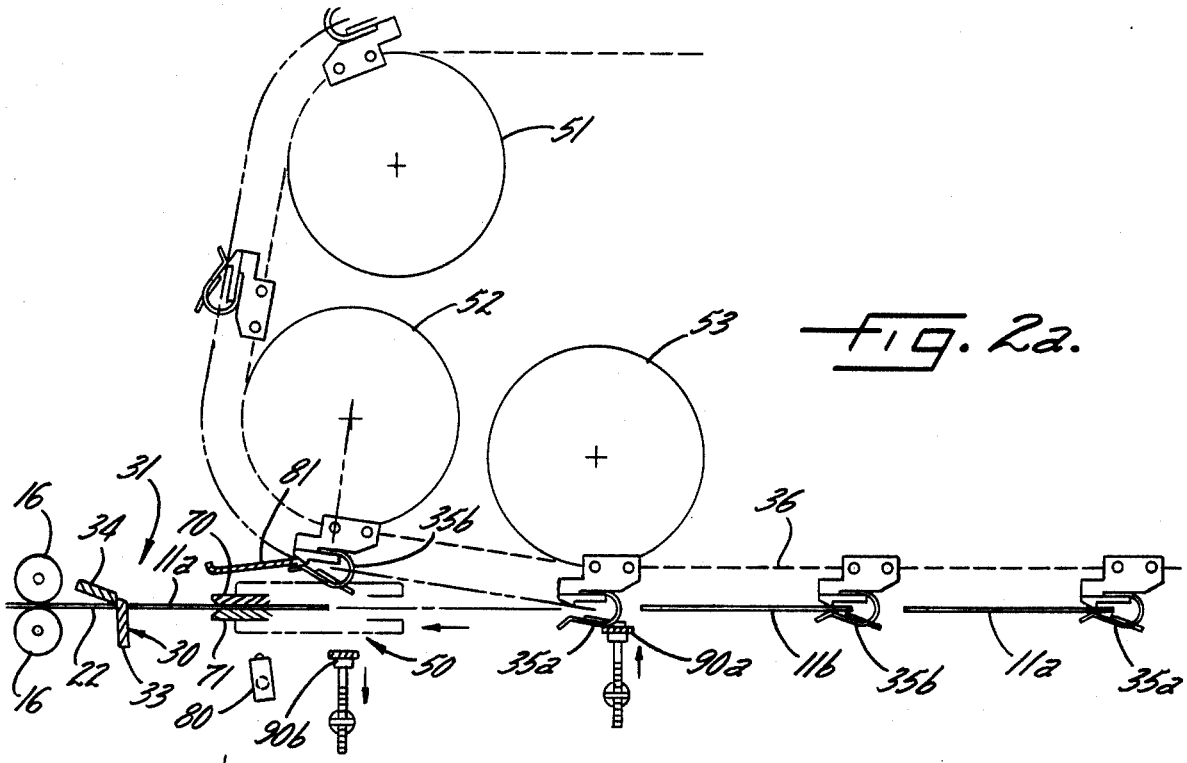
FIGS. 2*a*, 2*b* and 2*c* are schematic top plan views showing the successive positions of various parts of the machine as the pouches are transferred from the pouch making section to the pouch filling section.

More specifically, the chain 36 is positioned so as to enable a unique shuttle mechanism 50 to transfer a pouch 11*a* from the cutting unit 30 to the leading clamp 35*a* of each pair of clamps dwelling adjacent the cutting station 31 and to enable the next pouch 11*b* to be transferred directly from the cutting unit to the trailing clamp 35*b* of the pair. As shown in FIGS. 2*a* and 3, the upstream end of the chain 36 is trained around three guide sprockets, namely, a rear sprocket 51, an intermediate sprocket 52 and a forward sprocket 53. The intermediate sprocket 52 is located upstream of the forward sprocket 53 and also is spaced laterally to the rear of that sprocket. As a result, when each paired set of clamps 35*a*, 35*b* dwells adjacent the cut-off station 31 as shown in FIG. 2*a*, the leading clamp 35*a* of the pair lies directly on a straight line extending from the pouch strip 22 and extending parallel to the straight forward run of the chain 36. The trailing clamp 35*b* of the dwelling pair, however, is spaced laterally a short distance to the rear of the path of the pouch strip. As a result, the shuttle mechanism 50 may move a pouch 11*a* from the cut-off station 31 to the dwelling clamp 35*a* without interference from the paired trailing clamp 35*b*.

Figure 2B:
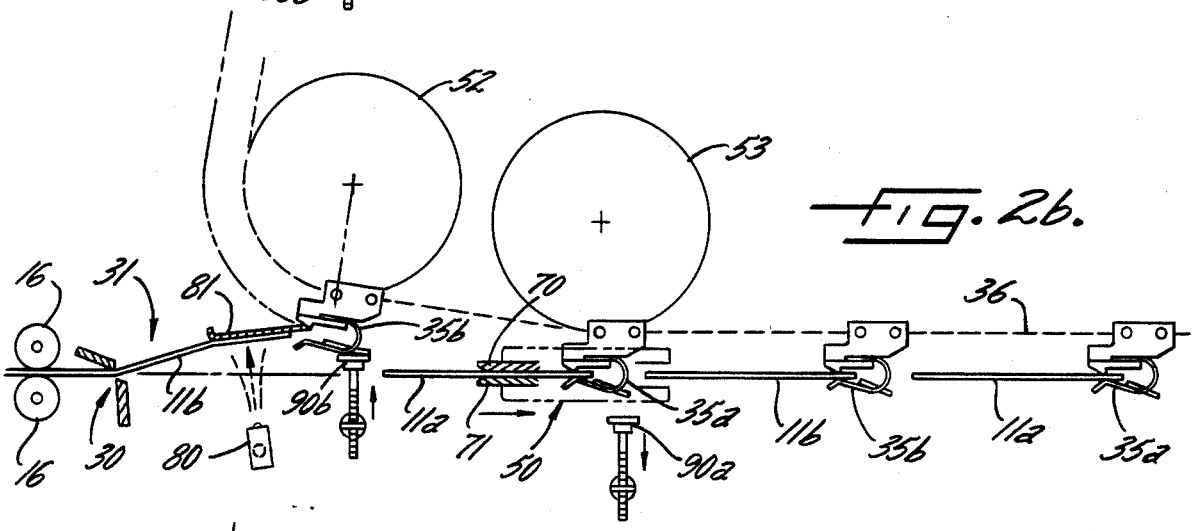
Figure 5:
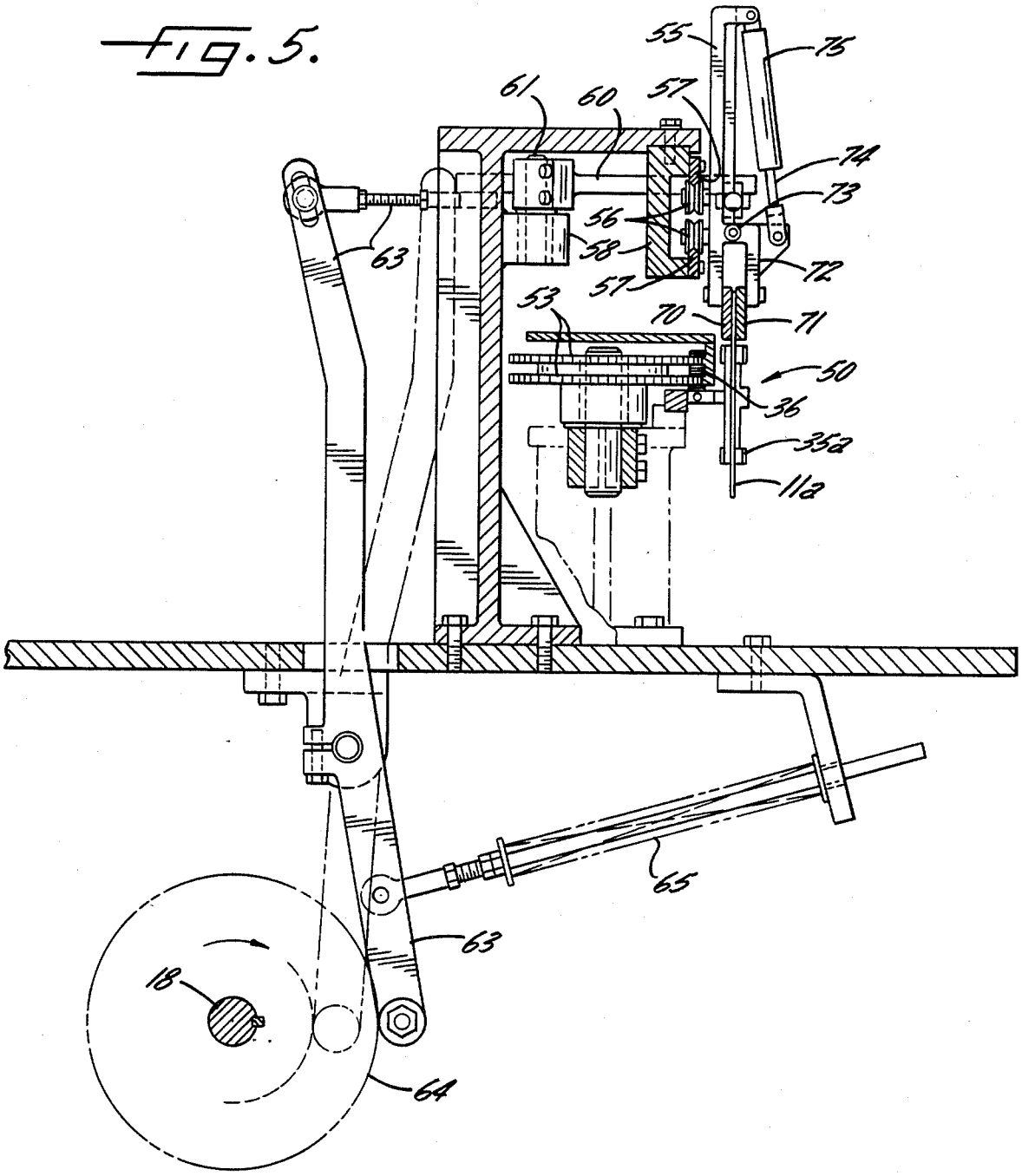
FIG. 5 is an enlarged fragmentary cross-section taken substantially along the line 5—5 of FIG. 3.

The shuttle mechanism 50 is shown most clearly in FIGS. 3 to 5 and comprises a carriage 55 located above the path of the severed pouches 11. Three grooved rollers 56 on the rear side of the carriage support the carriage to move back and forth along the pouch path on tracks 57 which are fastened to a fixed bracket 58. To effect such movement, a link 59 is pivotally connected at one end to the carriage and is pivotally connected at its other end to one arm of a bellcrank 60. The latter is pivotally connected to the bracket 58 at 61 and is adapted to be rocked back and forth about the pivot 61 by a pivoted linkage 63 (FIG. 5) which is actuated in a conventional manner by a cam 64 on the cycle shaft 18 and by a spring 65 acting in opposition to the cam. When the bellcrank 60 is oscillated about the pivot 61 by the linkage 63, the carriage 55 of the shuttle 50 is reciprocated back and forth between a pouch pick-up position (FIGS. 2*a* and 2*c*) and a pouch delivery position (FIG. 2*b*).

Pursuant to the invention, a gripping device is movable with the carriage 55 and is adapted to grip and release the pouches 11*a*. Herein, the gripping device comprises a fixed jaw 70 (FIGS. 2*a* and 5) attached to the carriage and disposed on the opposite side of the pouch path from a movable jaw 71. The latter is attached to a mounting bracket 72 which is pivotally connected to the carriage at 73 (FIG. 5) to enable the movable jaw to swing between open and closed positions relative to the fixed jaw. Such swinging is effected by a reciprocating pneumatic actuator having a rod 74 pivotally connected to the bracket 72 and having a cylinder 75 pivotally connected to the carriage 55. The movable jaw 71 is opened and closed when the rod 74 is retracted and advanced, respectively, in timed relation with movement of the carriage and in a conventional manner under the control of a cam (not shown) on the cycle shaft 18.

The invention is completed by means for deflecting each pouch 11*b* in the cutting station 31 out of the path of the shuttle 50 and into the clamp 35*b* which dwells adjacent the cutting station. In this instance, these means comprise a vertically elongated nozzle 80 located adjacent the cutting station 31 and disposed outwardly of the pouch path. Each time a pouch 11*b* moves into the cutting station, the nozzle is momentarily pressurized and shoots laterally directed jets of air toward the pouch. As a result, the pouch is deflected rearwardly and laterally of the path of the strip 22, is deflected out of the path of the shuttle 50 and is deflected toward the laterally offset trailing clamp 35*b* adjacent the cutting station. A back-up plate 81 is located on the side of the pouch path opposite the nozzle and supports the pouch 11*b* when the latter is deflected by the air jets. An opening 82 (FIG. 4) is formed through the back-up plate to allow the clamps to pass through the plate when the chain 36 is indexed.

In operation of the preferred machine 10, the feed rolls 16 are intermittently rotated so as to advance the pouch strip 22 through 200 steps per minute with each step being equal in length to the width of a pouch 11. The chain 36, however, is indexed so as to advance the clamps 35 through only 100 steps per minute with each step being equal in length to twice the spacing between paired leading and trailing clamps 35*a* and 35*b*. Each time the chain dwells, a pair of clamps 35*a* and 35*b* stops adjacent the cutting station 31 in the position shown in FIG. 2*a*. When the clamps 35*a* and 35*b* stop, they are opened by conventional actuators 90*a* and 90*b*, respectively, operated by the cycle shaft 18.

Figure 2C:
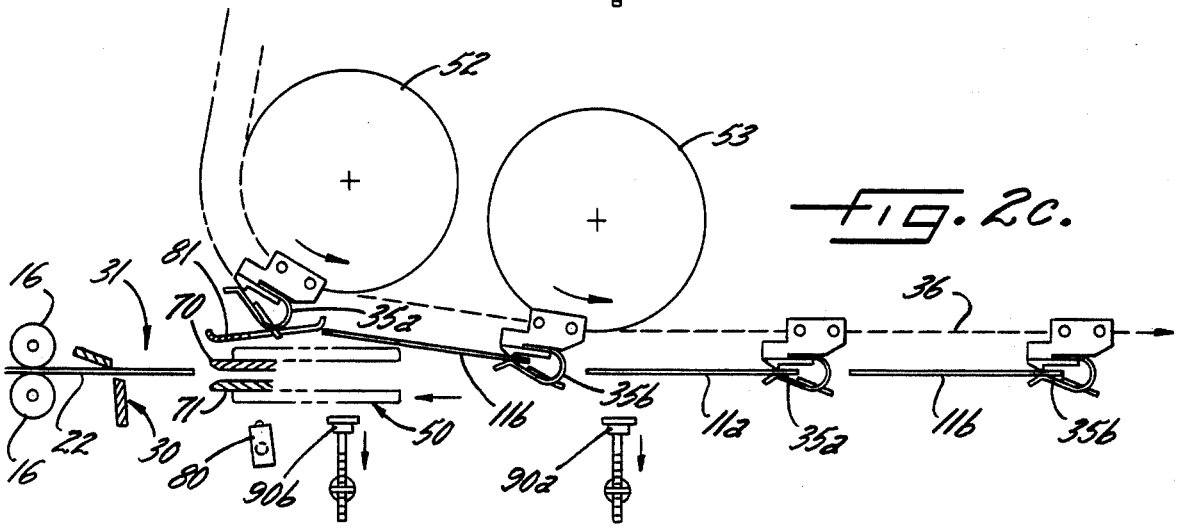

When the chain 36 first stops, the shuttle 50 is located in its pick-up position as shown in FIG. 2*a* but its jaws 70 and 71 are open as shown in FIG. 2*c*. As the feed rolls 16 advance the leading end portion of the pouch strip 22 past the cutting unit 30, the leading pouch 11*a* enters the jaws 70 and 71 and, when the strip dwells, the movable jaw 71 is moved to its closed position by the rod 74 so as to cause the jaws to grip the pouch. Thereafter, the cutting unit 30 is actuated to sever the leading pouch 11*a* from the strip 22.

Next, the shuttle 50 is shifted in a downstream direction to deliver the gripped pouch 11*a* into the open clamp 35*a* (see FIG. 2*b*). Once the pouch has entered the clamp 35*a*, the actuator 90*a* is retracted to cause the clamp to close and grip the pouch. The movable jaw 71 of the shuttle then is opened.

While the shuttle 50 is traveling in a downstream direction and while the clamps 35*a* and 35*b* are still dwelling, the pouch strip 22 is indexed to cause the next pouch 11*b* to advance past the cutting unit 30. At this time, the nozzle 80 is pressurized and thus the air jets deflect the pouch 11*b* laterally against the back-up plate 81, the deflected pouch entering the open clamp 35*b* adjacent the cut-off station 31. As soon as the strip 22 dwells, the actuator 90*b* is retracted to cause the clamp 35*b* to close and grip the pouch. The cutting unit 30 then is actuated to sever the pouch 11*b* from the strip 22. Thereafter, the chain 36 is indexed to advance the newly loaded clamps 35*a* and 35*b* toward the fillers 42*a* and 42*b* and to advance the next pair of clamps to a position adjacent the cutting station (see FIG. 2*c*). During cutting of the pouch 11*b* and indexing of the chain 36, the shuttle 50 is moved upstream into position to receive the next pouch 11*a*. Clearance for such movement exists by virtue of the laterally deflected position of the pouch 11*b* and the laterally offset position of the clamp 35*b*.

From the foregoing, it will be apparent that the present invention brings to the art a new and improved packaging machine 10 in which the pouch filling section 14 advances the severed pouches 11 in a single row and at one-half the index cycle rate at which the pouch making section advances the strip 22. This enables the machine to operate at a high pouch output rate while avoiding high frequency starting and stopping of the chain 36, while avoiding the complexities of two rows of pouches or duplicate pouch making mechanisms and while enabling the pouch strip 22 to be advanced in short and easily controllable steps each equal in length to the width of a pouch. Those familiar with the art will appreciate that certain principles of the invention also may be applied to machines in which the index cycle rate of the pouch filling section is a different fraction (e.g., $\frac{1}{3}$ or $\frac{1}{4}$) of the index cycle rate of the pouch making section.

We claim:

1. A packaging machine comprising means for longitudinally and intermittently advancing an elongated strip of interconnected pouches of equal width along a predetermined path to a cut-off station through cut-off distances each equal in length to the width of each pouch, means at said cut-off station for cutting a single pouch from the leading end portion of the strip each time the strip dwells, a series of movable pouch clamps operable to move successive severed pouches in spaced edgewise relation away from the cut-off station and in a single row along a second predetermined path, said clamps being spaced from one another along said second path, one clamp of each successive pair of clamps along the second path being operable to grip a pouch at said cut-off station both prior to and after cutting of such pouch from said strip, means for transferring another severed pouch from said cut-off station to the other clamp of said pair of clamps, and means for intermittently advancing said clamps through one cut-off distance each time said strip is advanced through two cut-off distances.

2. A packaging machine as defined in claim 1 in which said means for advancing said clamps comprise an intermittently movable endless chain to which said clamps are secured, one clamp of each pair being a leading clamp and the other clamp of each pair being a trailing clamp, and means guiding said chain and causing the leading clamp of each pair to be in line with said strip and causing the trailing clamp of each pair to be laterally offset from said strip when said pair of clamps dwells adjacent said cut-off station.

3. A packaging machine as defined in claim 2 further including means adjacent said cut-off station for deflecting every other pouch laterally of said strip and into the trailing clamp of each pair prior to the time such pouch is severed from said strip.

4. A packaging machine as defined in claim 3 in which said deflecting means comprise means for directing a flow of pressurized air laterally against every other pouch which dwells in said cut-off station.

5. A packaging machine as defined in claim 2 in which said transferring means comprise a shuttle movable back and forth along a straight path in line with said strip between a pick-up position near said cutting means and a delivery position near the leading clamp of the pair dwelling adjacent said cut-off station, and means on said shuttle for gripping a pouch each time said shuttle is in said pick-up position and prior to the time the pouch is severed from said strip, said gripping means releasing the gripped pouch to the leading clamp of said pair each time said shuttle is in said delivery position.

6. A packaging machine as defined in claim 5 further including means adjacent said cut-off station for deflecting every other pouch laterally out of the path of said shuttle and laterally into the trailing clamp of each pair prior to the time such pouch is severed from said strip and prior to the time said shuttle moves to said pick-up position.

7. A packaging machine comprising means for longitudinally and intermittently advancing an elongated strip of interconnected pouches of equal width along a first generally straight path to a cut-off station through cut-off distances each equal in length to the width of each pouch, a cutter at said cut-off station and operable to sever the leading pouch from the end of said strip each time the strip dwells, a series of pouch clamps operable to move successive severed pouches in spaced edgewise relation away from the cut-off station and in a single row along a second generally straight path which forms a substantially straight continuation of said first path, said clamps being spaced from one another along said second path, means for intermittently advancing said clamps through distances each equal to twice the center-to-center distance between adjacent severed pouches, said clamps being advanced once each time said strip is advanced twice, one clamp of each successive pair of clamps along said second path receiving a severed pouch at said cut-off station each time said clamps dwell, and means for transferring another severed pouch from said cut-off station to the other clamp of each pair of clamps each time said clamps dwell.

8. A packaging machine comprising first advancing means for longitudinally and intermittently indexing an elongated strip of interconnected pouches of equal width through cut-off distances each equal in length to a multiple of the width of each pouch, means operable when the strip dwells between successive cut-off distances to cut from the leading end portion of the strip a number of pouches equal to said multiple, a series of spaced pouch clamps operable to grip successive severed pouches and to advance groups of the severed pouches in predetermined spaced edgewise relation away from the leading end of the strip, said clamps being positioned to advance all of the severed pouches along a single row, and second advancing means for intermittently indexing said clamps through distances each equal in length to a multiple of the center-to-center distance between a severed pouch and a corresponding severed pouch of an adjacent group, said second advancing means being operable during a given cycle to index said clamps a number of times which is a fraction of the number of times said first-mentioned advancing means indexes said strip during said cycle, said fraction being equal to the reciprocal of the number of pouches in each group.

9. A method for cutting pouches from an elongated strip of interconnected pouches and for subsequently advancing the severed pouches, said method comprising the steps of, longitudinally and intermittently advancing the strip of interconnected pouches, severing pouches from the leading end portion of said strip during a number of repetitive cutting cycles, and intermittently advancing all of the severed pouches in spaced edgewise relation along a single row and through repetitive index cycles equal in number during a given time period to a fraction of the number of cutting cycles effected during the same time period.

10. A method as defined in claim 9 in which said strip is advanced during each cutting cycle through a distance which is a multiple of the center-to-center distance between adjacent interconnected pouches in the strip, said severed pouches being advanced during each index cycle of the severed pouches through a distance which is a multiple of the center-to-center distance between non-adjacent severed pouches.

11. A method for cutting pouches from an elongated strip of interconnected pouches of equal width and for subsequently advancing the severed pouches, said method comprising the steps of, subjecting said strip of interconnected pouches to repetitive cycles, each of said cycles comprising:

(a) advancing the strip longitudinally along a predetermined path through a distance which is a multiple of the width of each pouch, (b) allowing the strip to dwell after each advance, and (c) cutting from the leading end portion of the strip during each cycle a number of pouches equal to said multiple, and intermittently advancing all of said severed pouches in spaced edgewise relation in groups of at least two along a single row and through distances each having a length which is a multiple of the center-to-center distance between corresponding pouches of adjacent groups.

* * * * *